US007912238B2

(12) United States Patent
LaMarra

(10) Patent No.: US 7,912,238 B2
(45) Date of Patent: Mar. 22, 2011

(54) SPEAKER ATTENUATION SYSTEM, METHOD AND APPARATUS

(76) Inventor: Frank LaMarra, West Bloomfield, MI (US)

( * ) Notice: Subject to any disclaimer, the term of this patent is extended or adjusted under 35 U.S.C. 154(b) by 1377 days.

(21) Appl. No.: 11/332,882

(22) Filed: Jan. 13, 2006

(65) Prior Publication Data

US 2007/0165894 A1 Jul. 19, 2007

(51) Int. Cl.
*H04R 1/20* (2006.01)
*H04R 25/00* (2006.01)

(52) U.S. Cl. ..... 381/346; 381/150; 381/347; 381/354

(58) Field of Classification Search ..... 381/346
See application file for complete search history.

(56) References Cited

U.S. PATENT DOCUMENTS 3,833,085 A * 9/1974 Thomasen ..... 181/164
6,826,287 B2 * 11/2004 Myers ..... 381/373

OTHER PUBLICATIONS

WeberVST Products, www.webervst.com/public.htm, Apr. 30, 2004, per Internet Archive Wayback Machine.

Beam BlockerBeam-tm, www.webervst.com/blocker.html, Jul. 21, 2004, per Intenet Archive Wayback Machine.

Weber Beam Blockers, www.guitarplayer.com/story.asp?sectioncode=6&storycode=11734, Dec. 2005.

SoundEflect Products, Flapjack Guitar Amp Speaker Frequency Blocker, www.soundeflect.com/productinfo.htm, 2006.

* cited by examiner

*Primary Examiner* — Curtis Kuntz
*Assistant Examiner* — Matthew Eason
(74) *Attorney, Agent, or Firm* — Harness, Dickey & Pierce, PLC

(57) ABSTRACT

A speaker attenuation system includes an attenuating member comprised of suitable material and having a size and a shape capable of attenuating a speaker when positioned in a central beam region of the speaker. A positioning mechanism is capable of positioning the attenuating member predominantly in the central beam region of the speaker in such a manner that it is between the speaker and an audience in a performance setting. The suitable material, such as open cell foam (i.e., acoustic foam), preferably has a property that it is capable, at one or more thicknesses, of reducing amplitudes of a majority of frequencies between one-thousand and eight-thousand Hertz by at least six decibels without reducing amplitudes of any frequencies in that range by more than eighteen decibels. Accordingly, the "beaminess" of the speaker can be reduced without creating a "hole in the sound."

32 Claims, 7 Drawing Sheets

SPEAKER ATTENUATION SYSTEM, METHOD AND APPARATUS

FIELD

The present disclosure generally relates to speakers and speaker cabinets for use with musical instruments, and relates in particular to attenuation of a speaker.

BACKGROUND

The statements in this section merely provide background information related to the present disclosure and may not constitute prior art.

Speakers and speaker cabinets, and guitar speaker cabinets in particular, have long suffered from a tendency to project frequencies unevenly to an audience, such as performers, listeners, and microphones positioned in front of the speakers. With reference to FIG. 3A, a typical speaker mounted in a speaker cabinet, tends to project sound in a beam in front of the speaker cabinet. This beam has a central beam region 100, and outer beam regions 102A and 102B. In general, the higher frequencies, such as frequencies above one-thousand Hertz, present in the central beam region 100 are significantly greater in amplitude than the lower frequencies, such as those below one-thousand Hertz, present in that region. Conversely, the higher frequencies present in the outer beam regions 102A and 102B tend to be of lesser amplitude than the higher frequencies present in the central beam region 100. These higher frequencies present in the outer beam regions 102A and 102B also tend to more closely match the lower frequencies present in the outer beam regions 102A and 102B. As a result, the outer beam regions 102A and 102B are generally perceived by musicians, recording professionals, and others as having a more even tone than the central beam region 100.

Turning now to FIG. 5, a response curve 500 produced by placing the microphone close to the cabinet of FIG. 3A in the central beam region demonstrates the increased amplitude of higher frequencies in the central beam region. As a general rule, the higher the frequency, the more narrow the "beam" of that frequency that tends to be projected forward from the voice coil in the center of the speaker. This voice coil vibrates during operation, causing a conical membrane of the speaker that is attached to the voice coil to similarly vibrate. In contrast to the higher frequencies, lower frequencies tend to project forward from the entire conical membrane and disperse evenly in front of the speaker.

While response curve 500 extends from five-hundred Hertz to eight-thousand Hertz, it should be readily apparent to one skilled in the art that the range of human hearing extends from about twenty Hertz to about twenty-thousand Hertz. It should also be readily apparent that musical instruments, such as guitars, are typically only capable of playing notes in a range from about forty Hertz, in the case of a contra base guitar, to about one-thousand seven-hundred sixty Hertz, in the case of an alto guitar. However, musical instruments, and especially electric guitars, can produce higher frequencies as harmonic overtones, especially in the case of tube amp distortion for an electric guitar or use of artificial aural excitation for an electric/acoustic guitar. These harmonic overtones can easily range up to eight-thousand hertz. Thus, the presence of higher frequencies dramatically effects the tone of an amplified guitar signal.

Moreover, one skilled in the art will readily recognize that decibels are a logarithmic measure, and that perceived loudness of a sound is generally known to double with an increase of ten decibels. This perceived loudness does not directly relate to actual intensity or amplitude, which doubles with an increase of three decibels. Moreover, perceived loudness, which is an experimentally obtained psychoacoustic measure typically expressed in phons, does not directly correspond to decibels. Typically, a contouring filter, such as an A filter generally accepted for use in musical applications, can be applied to a rough conversion of decibels to phons, with the units expressed as dBA, dBB, or dBC, depending on the filter employed. Alternatively, a conversion table available in acoustics textbooks can be employed to achieve a more accurate conversion expressable as phons. However, the difference between decibels and phons or dBA is mostly significant for frequencies below one thousand Hertz and above eight thousand Hertz. For example, one skilled in the art will readily recognize that application of an A filter to curve 500 would leave points of the curve the same at one-thousand Hertz and five-thousand Hertz, while adjusting other frequencies between one-thousand and eight thousand Hertz by no more than about two decibels. Such application would, however, significantly reflect a decrease in the perceived loudness of lower frequencies below one-thousand Hertz. Accordingly, the difference between perceived loudness of the higher and lower frequencies is even more dramatic than might be otherwise reflected by curve 500.

The increased amplitude of the higher frequencies in the central beam region is generally referred to as "beaminess," and has long been known to be an undesirable characteristic of speakers, and especially of guitar speaker cabinets, that causes various undesirable results. For example, audience members closer to the stage and positioned to receive the central beam experience "ice pick highs" or "sizzle" generally perceived as unpleasant. Also, recording professionals in the past have discovered that positioning a recording microphone in the central beam region produces undesirable results, and have learned to position the microphone in one of the outer beam regions. Similarly, live sound technicians, especially at larger venues, also need to mic one or more speakers of a guitar speaker cabinet for sound reinforcement through local PA systems. However, more often than not, these live sound technicians tend to place the microphone in the central beam region. As a result, the sound emanating from the PA system tends to be unbalanced, and the entire audience experiences the unpleasant "ice pick highs" or "sizzle."

Turning now to FIG. 3B, attempts to reduce "beaminess" of a speaker cabinet have generally involved blocking the sound emanating from the central beam region 100. For example, others have tried placing a blocking member 106 composed of duct tape, felt, metal, fiber, and/or wood between the speaker and the audience in the central beam region 100. Typically, the blocking member 106 has been mounted inside the screen of the cabinet by attaching the blocking member 106 to the inside surface of the screen, or by providing one or more spokes extending from the cabinet baffle board on which the speaker is mounted, and attaching it to the spoke or spokes. Specifically, duct tape and/or felt discs have been attached to the screen, while wooden discs or metal and fiber discs have been mounted on spokes. Typically, the discs have been four to six inches in diameter for ten to twelve inch speakers, and slightly larger for fifteen inch speakers.

Returning now to FIG. 5, a response curve 502 produced by placing the microphone close to the blocked cabinet of FIG. 3B in the central beam region demonstrates the decreased amplitude of higher frequencies in the central beam region. Specifically, response curve 502 demonstrates the decreased amplitude of higher frequencies in the central beam region when a square section cut from a 2×4 wooden board made of pine is used as the blocking member 106. Low peaks 504A-504D in response curve 502 demonstrate that a perceptible "hole in the sound" exists for several of the higher frequencies in the central beam region when blocking is used. Blocking is known to be effective in reducing the "ice pick highs" received directly from the cabinet by audience members positioned in the central beam region. However, the "hole in the sound" is experienced by the audience in the central beam region. This "hole in the sound" is also experienced by the rest of the audience when live sound technicians inevitably place the microphone in the central beam region. As a result, most or all of the audience at a large venue experiences an unpleasantly "muddy" tone from the speaker being piped through the PA system of the venue.

Accordingly, the need remains for a way to reduce the unevenness, or "beaminess," of a speaker without creating a perceptible "hole in the sound" in the central beam region. The present invention fulfills this need.

SUMMARY

A speaker attenuation system includes an attenuating member comprised of suitable material and having a size and a shape capable of attenuating a speaker when positioned in a central beam region of the speaker. A positioning mechanism is capable of positioning the attenuating member predominantly in the central beam region of the speaker in such a manner that it is between the speaker and an audience in a performance setting. The suitable material, such as open cell foam (i.e., acoustic foam), preferably has a property that it is capable, at one or more thicknesses, of reducing amplitudes of a majority of frequencies between one-thousand and eight-thousand Hertz by at least six decibels without reducing amplitudes of any frequencies in that range by more than eighteen decibels. Accordingly, the "beaminess" of the speaker can be reduced without creating a "hole in the sound."

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
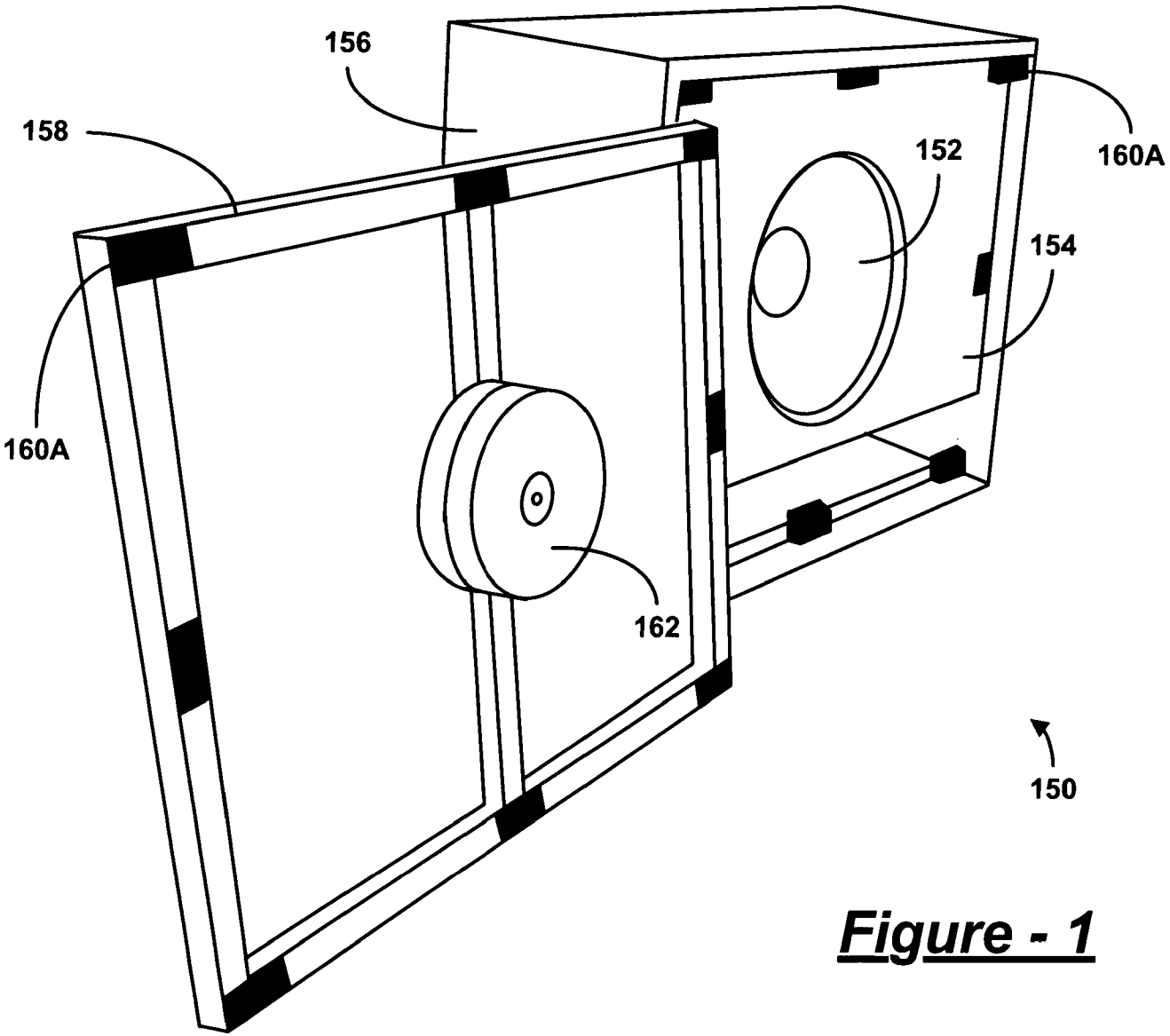
FIG. 1 is a perspective view of an attenuated speaker cabinet in accordance with the present teachings.

Turning now to FIG. 1, a guitar speaker cabinet 150 has a guitar speaker 152, such as a twelve inch guitar speaker, mounted on a baffle board 154 affixed within a housing 156 composed of wood and vinyl. A screen 158 is positioned in a front side of the housing 156 to protect the speaker. The screen 158 is removable. Fasteners, 160A and 160B, such as Velcro patches, can be used to hold a removable screen in place when it is attached to the housing, yet allow easy removal of the screen 158. It should be readily understood that when Velcro patches are employed as fasteners 160A and 160B, a ring patch is mated to a hook patch in order to effect fastening. Other useful fastening mechanisms will be readily apparent to those skilled in the art.

In accordance with the present teachings, an attenuating member 162 is positioned predominantly in the central beam region of the cabinet speaker 152 when the cabinet 150 is being operated to produce sound in a performance setting. Preferably, the attenuating member is positioned proximate to the speaker in the performance, such as within two or three inches of the speaker. For example, the attenuating member can be attached to one or more portions of the guitar speaker cabinet in such a manner that it is properly positioned when the cabinet is assembled for operation. In a presently preferred embodiment, the attenuating member 162 is disc-shaped and centered in front of the voice coil of the speaker 152. The attenuating member 162 also preferably includes one or more layers of open cell foam, also known as acoustic foam. A layer can be one inch thick. A layer can also be six inches in diameter, especially for a twelve inch guitar speaker. Thus, two or more layers can be combined to form the attenuating member 162 when the speaker 152 is relatively new and therefore more "beamy." Then, as the speaker 152 ages and becomes less and less "beamy," layers can be progressively removed to effect less and less attenuation of the higher frequencies in the central beam region.

The attenuating member 162 can, for example, be attached to an interior of the screen 158 in any suitable manner. The attachment of the attenuating member 162 can be accomplished using a bolt assembly through a center of the attenuating member that is received in a wooden strut of the screen 158. When layers are removed, a shorter bolt can be used. It should be readily understood that the attenuating member can alternatively or additionally be mounted to the exterior of the screen 158, to the baffle board 154, the housing 156, and/or to the speaker 152. Moreover, any number of attachment mechanisms, such as nails, rivets, screws, staples, glue, gum, thread, latches, straps, etc. can be employed. This list of potential attachment mechanisms is not meant to be limiting in any way. Further, the attenuating member does not have to be attached to the cabinet or any of its components, but can be positioned in the central beam region in any manner.

Figure 2B:
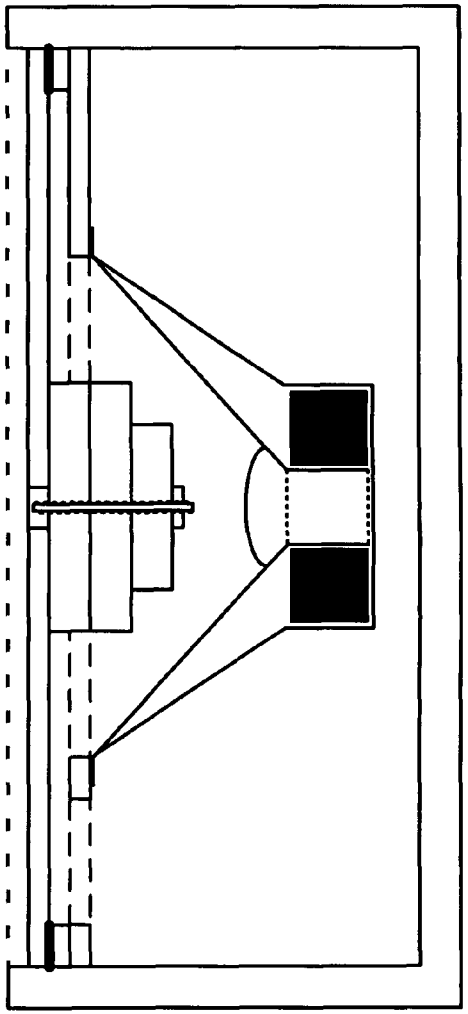
FIGS. 2A and 2B are cross-sectional side views of the attenuated speaker cabinet of FIG. 1 in open and closed positions.
Figure 2A:
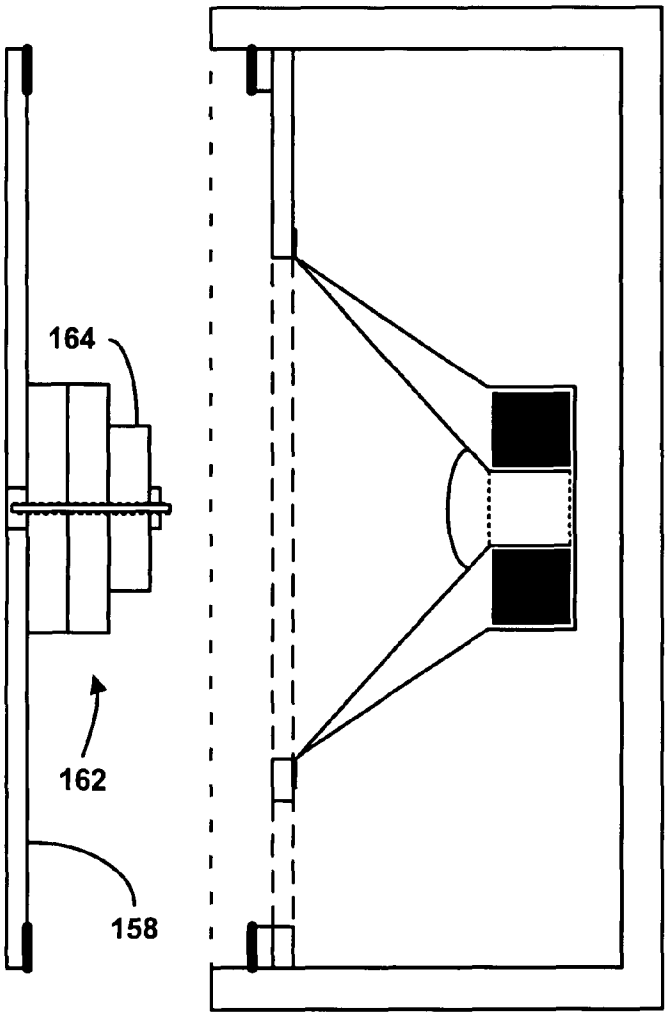
Figure 3A:
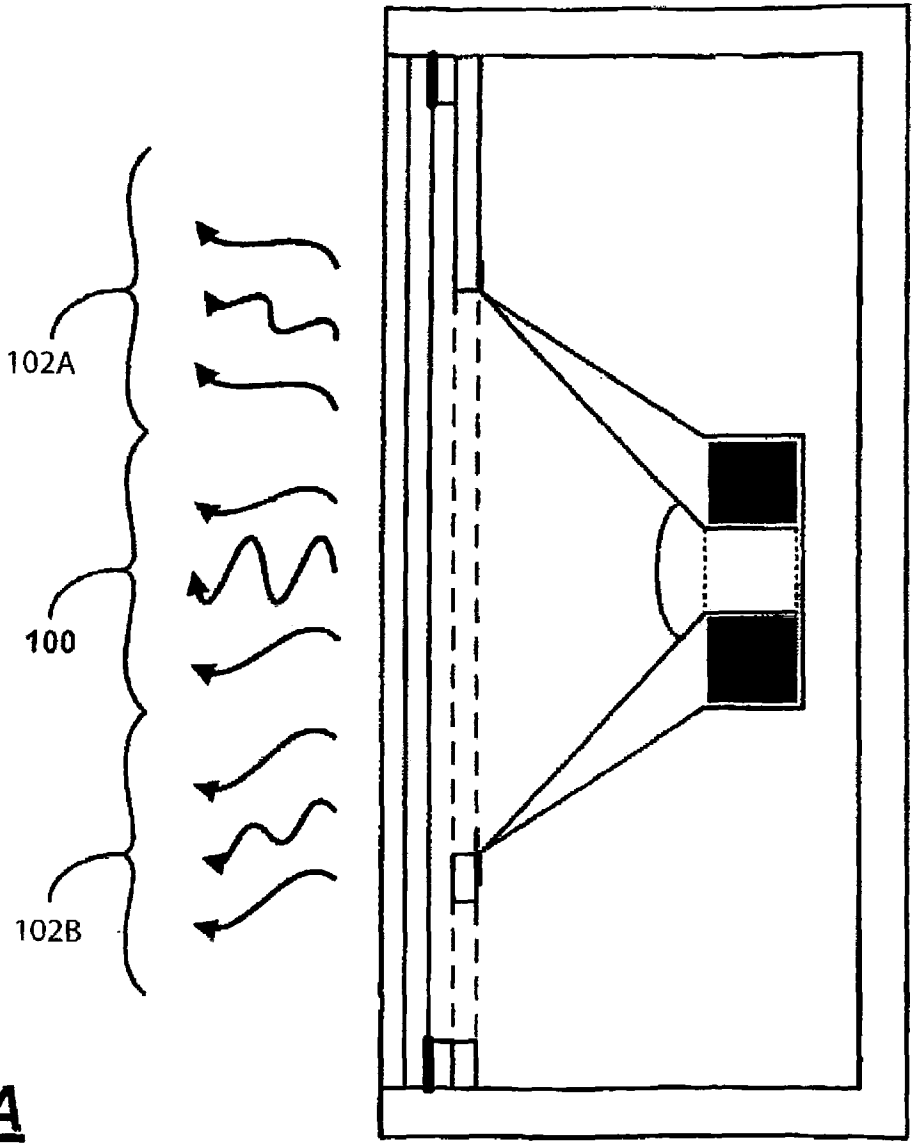
Prior Art Figure - 3A
FIG. 3A is a cross-sectional side view of a speaker cabinet in accordance with the prior art.
Figure 3B:
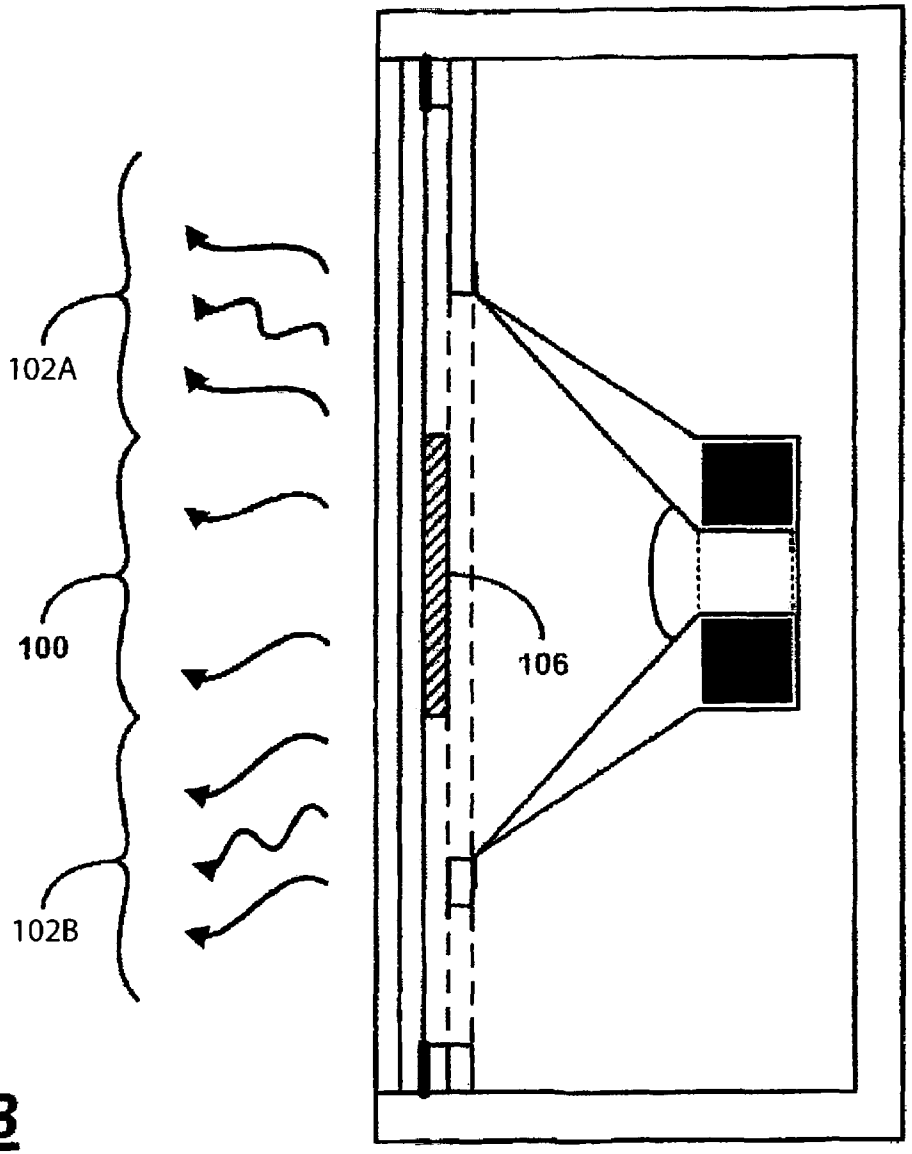
Prior Art Figure - 3B
FIG. 3B is a cross-sectional side view of a blocked speaker cabinet in accordance with the prior art.

Turning now to FIGS. 2A and 2B, proper attachment of the attenuating member 162 to an interior of the screen 158 allows the attenuating member 162 to be positioned proximate to the speaker within the central beam region and also out of sight of the audience when the screen 158 is attached to the housing 156. A third disc layer 164 can be added when the speaker is relatively new to affect more attenuation. Care can be taken to reduce diameter of the third disc layer 164 in order to ensure that the third disc layer 164 does not contact a surface of the speaker when the speaker is in operation. With a twelve inch guitar speaker, a four inch disc of one inch thick open cell foam centered with respect to other disc layers of the attenuating member 162 has been found to work well as a third disc layer. Accordingly, layers of the attenuating member 162 can be of different sizes. It should also be readily appreciated that there can be any number of layers of varying shapes and thicknesses.

Figure 4:
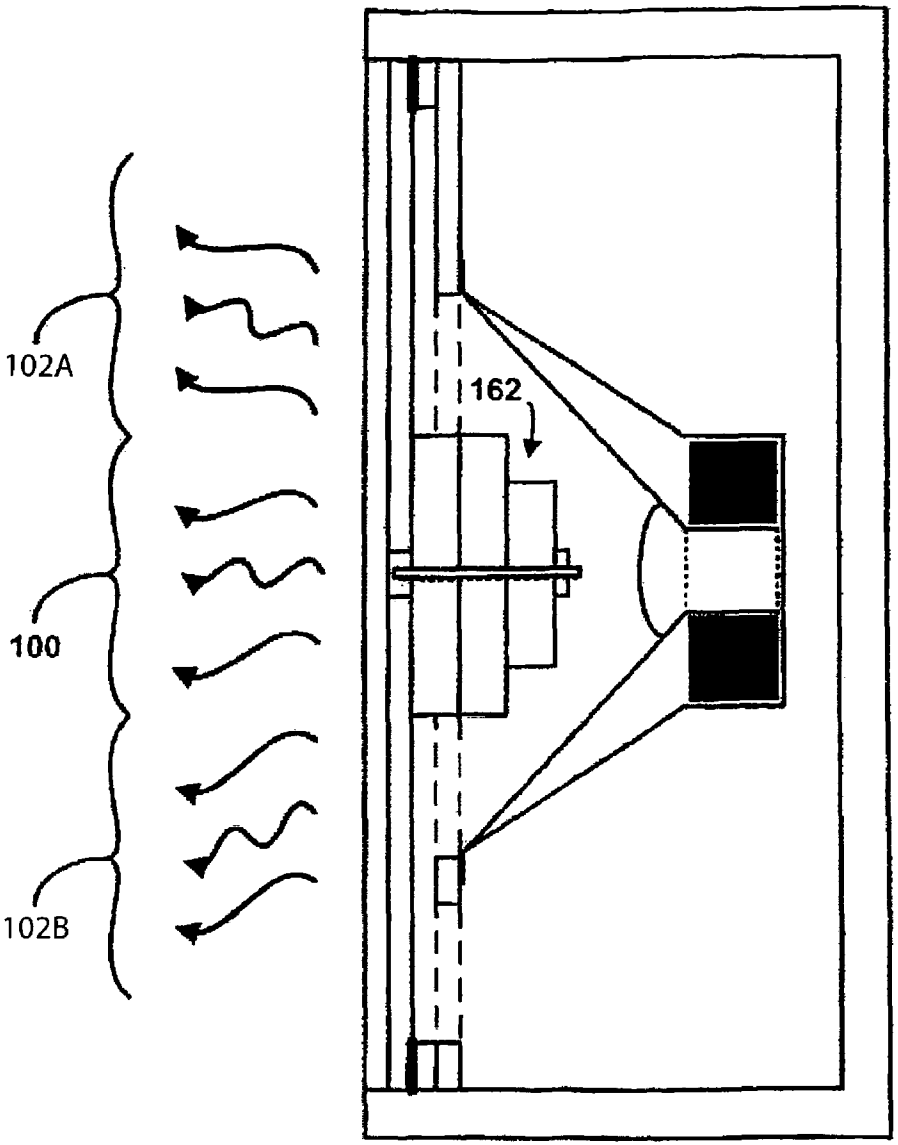
FIG. 4 is a cross-sectional side view of an attenuated speaker cabinet in accordance with the present teachings.

Turning now to FIG. 4, use of attenuating member 162 improves evenness of the speaker tone in a manner and to a degree that is readily perceptible to a listening guitar tone aficionado. In particular, the amplitude of higher frequencies in the central beam region 100 is reduced without creating a "hole in the sound." Overall, the higher frequency amplitudes are caused to more closely match the amplitudes of the lower frequencies in the central beam region 100. Moreover, the amplitudes of the lower frequencies in the central beam region 100 are not adversely affected. Accordingly, the amplitudes of higher frequencies in the central beam region 100 are made more similar to those of higher frequencies in the outer beam regions 102A and 102B without causing a dramatic mismatch in amplitudes of lower frequencies in the central and outer beam regions. In other words, the "beaminess" of the speaker is effectively reduced without creating a "hole in the sound" in the central beam region 100.

Figure 5:
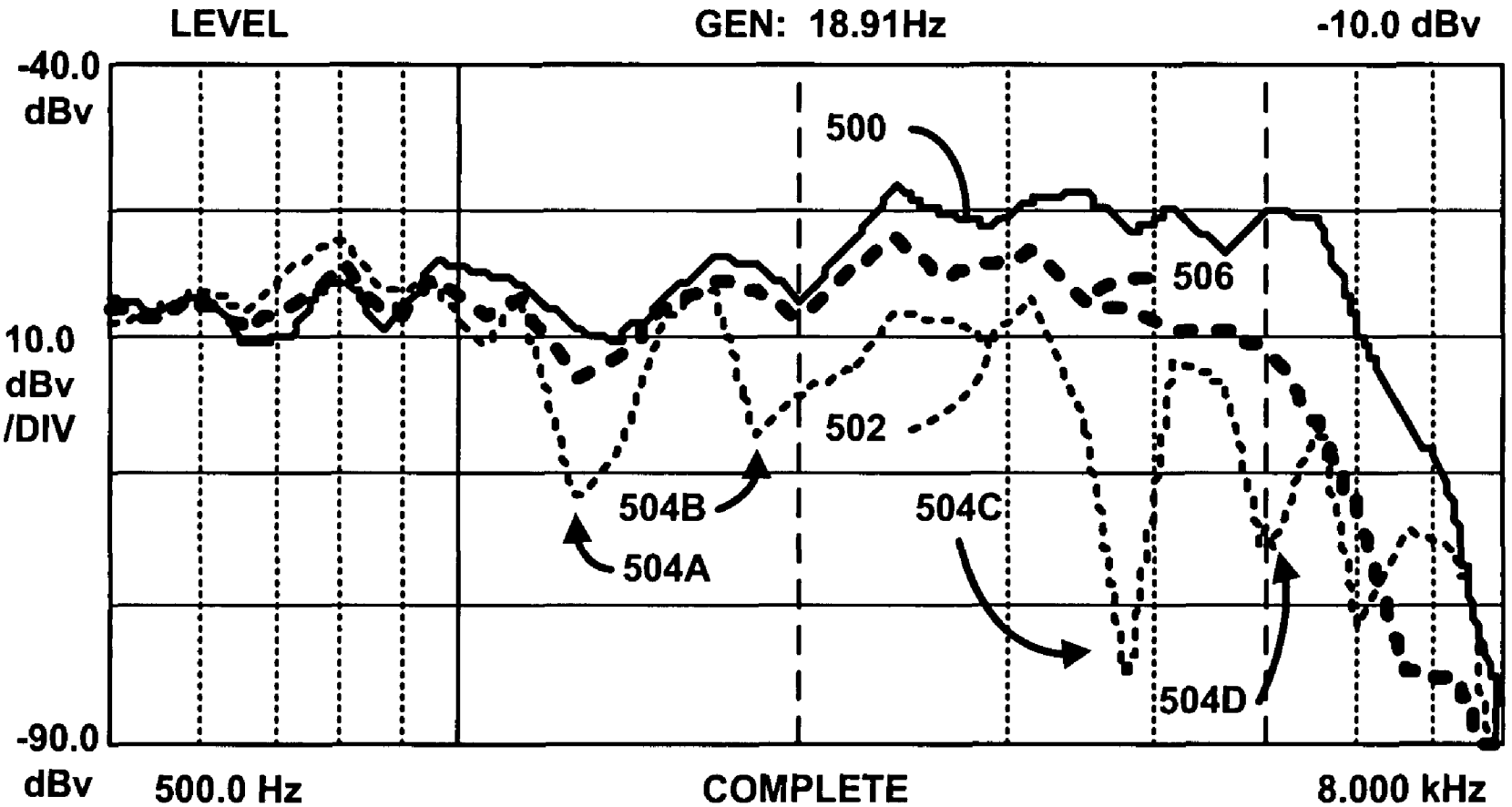
FIG. 5 is a two-dimensional, logarithmic scale graph of speaker response curves generated with a microphone positioned in a central beam region of a speaker cabinet, wherein the abscissa denotes frequency in Hertz and the ordinate denotes amplitude in decibels metering AC rms voltage, wherein the reference voltage is one volt rms.

Returning now to FIG. 5, response curve 506 produced by placing the microphone close to the attenuated cabinet of FIG. 1 in the central beam region demonstrates the decreased amplitude of higher frequencies in the central beam region without creating a "hole in the sound". Response curve 506 was produced using two one-inch thick discs of six inch diameter acoustic foam mounted centered in front of the voice coil of the speaker. The particular open cell foam (Product No. CFR-16070) was manufactured by Flexible Foam Products, Inc.™, located in Spencerville, Ohio. It was centered in front of a Celestion™ Classic Lead 80™ speaker by mounting it to the interior screen of a ported 1×12 Egnater™ speaker cabinet available from Music Products Group™ located in Oak Park, Mich. Compared to response curve 502, curve 506 clearly lacks low peaks like peaks 504A-504D of curve 506. Moreover, amplitudes of higher frequencies of curve 506 more closely match amplitudes of lower frequencies of curve 506, especially compared to curves 500 and 502. Thus, reduction of "beaminess" without creating a perceptible "hole in the sound" is effectively demonstrated. Finally, each of curves 500 and 506 were found to be significantly identical in the range of zero Hertz to five-hundred Hertz. Accordingly, the attenuating member does not adversely affect the amplitude of these lower frequencies.

It should be noted that open cell foam, while presently preferred as a material for the attenuating member, may be replaced with a future equivalent when it is discovered to have properties suitable for use as an attenuating member. Further, other shapes, sizes, and varieties of acoustic foam are available and may reveal different attenuation characteristics. In general, suitable properties for material used to form the attenuating member include the ability, at some uniform or non-uniform thickness, to reduce amplitude of a majority of frequencies between one-thousand and eight-thousand Hertz by at least six decibels without reducing amplitude of any frequencies in that range by more than eighteen decibels. It should be readily understood that the material need not be employed at a thickness to accomplish at least six decibels of attenuation for the majority of frequencies in the range. Rather, it is sufficient that the material be capable of so attenuating the frequencies at some thickness. More preferably, suitable properties for material used to form the attenuating member include the ability, at some uniform or non-uniform thickness, to reduce amplitude of a majority of frequencies between one-thousand and eight-thousand Hertz by at least eight decibels without reducing amplitude of any frequencies in that range by more than sixteen decibels. Moreover, it is envisioned that layers of different materials having different properties that are suitable when layered can be combined to form the attenuating member. In this case, the combination of materials has the suitable properties. One skilled in the art is reminded that the layers can be of different thicknesses, shapes, and sizes.

Various embodiments are possible according to suitable properties of material for forming the attenuating member. For example, in some embodiments, suitable properties will allow the material to reduce amplitudes of all frequencies between two and five thousand Hertz by at least four decibels without succeeding in reducing amplitudes of any of those frequencies by more than twelve decibels. In another additional or alternative embodiment, suitable properties will allow the material to reduce amplitudes of a majority of frequencies between two thousand and five thousand Hertz by at least four decibels without reducing amplitudes of any frequencies between one and five thousand Hertz by more than twelve decibels.

Figure 6B:
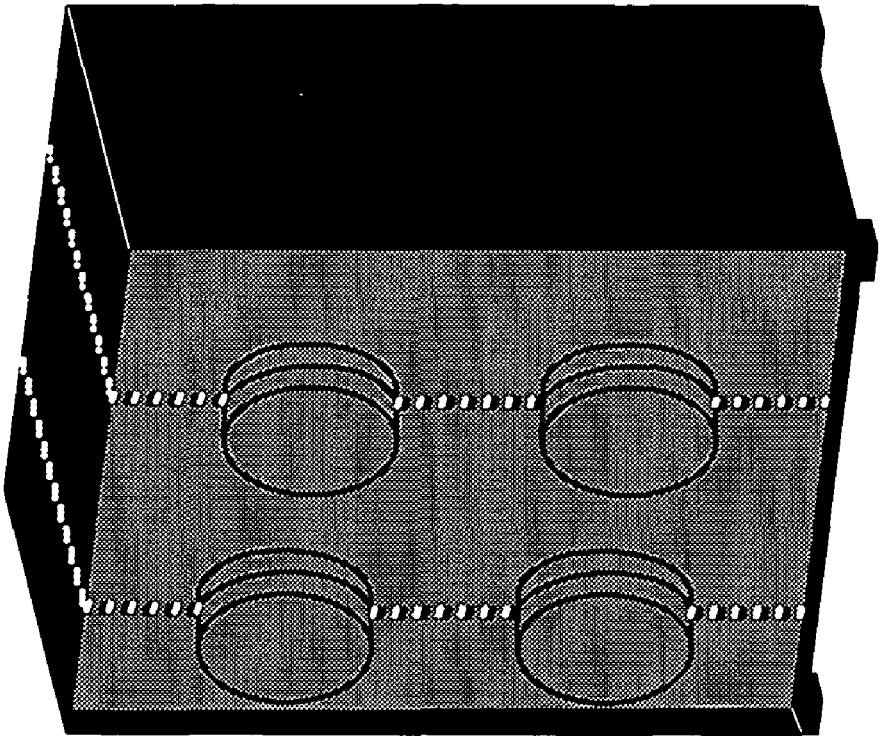
FIG. 6B is a perspective view of the speaker attenuation apparatus of FIG. 6A implemented to attenuate a 4×12 guitar speaker cabinet.
Figure 6A:
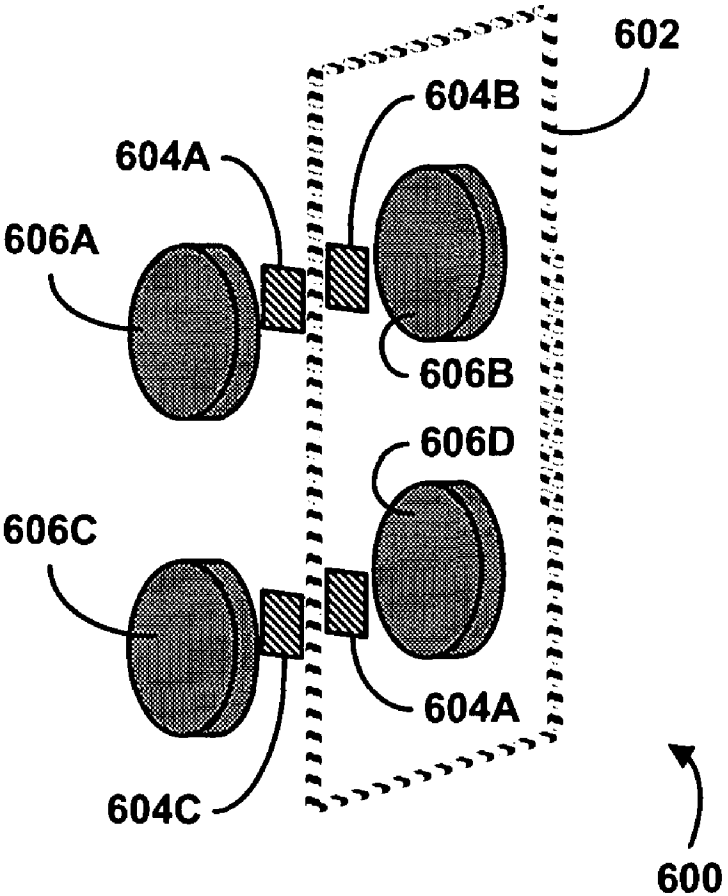
FIG. 6A is a perspective, blow up view of a speaker attenuation apparatus in accordance with the present teachings.

Turning now to FIG. 6A, a speaker attenuation apparatus 600 according to the present teachings includes an attenuating member. It also includes a positioning mechanism operable to position the attenuating member predominantly in the central beam region of a speaker when the speaker is being operated to produce sound in a performance setting. The positioning mechanism can be an attachment mechanism that is operable to attach the attenuating member to a speaker cabinet. For example, a strap 602 and sticky and/or Velcro patches 604A-604D can be provided in order to attach discs 606A-606D of acoustic foam to an exterior of a guitar cabinet. The discs 606A-606D can be colored or covered with material that causes them to have an appearance similar to a screen of a speaker cabinet. The strap 602 can be made of Velcro and/or elastic, can be light transmissive, and can be of sufficient length to vertically encircle one or more models of guitar cabinets. The patches 604A-604D can be attached by their sticky backs to the discs 606A-606D and mated to opposite surfaces of strap 602 so as to be hidden from sight when the apparatus 600 is assembled.

Turning now to FIG. 6B, one or more assembled apparatuses can be implemented to attenuate cabinets having multiple speakers, such as a 4×12 guitar cabinet. It should be readily appreciated that 1×12 cabinets will require that only one speaker be attenuated, while 2×12 cabinets and 4×12 cabinets can be provided with an attenuating member for one or more speakers. Running the strap vertically instead of horizontally facilitates effective positioning of the attenuating members with slanted cabinets. A clear strap and screen-colored discs assist in hiding the apparatus from the audience when applied externally. However, it is envisioned that some manufacturers and/or performers may choose to decorate or modify the appearance of the apparatus. For example, the attachment mechanism can appear as a chain and the attenuating members as skulls or pocket watches. Alternatively, the attachment mechanism can appear as a vine, and the attenuating members as flower blossoms. Other possible motifs and similar variation in equipment will be readily apparent to those skilled in the art, such as ropes and nets with fish, eyeballs, sports equipment, and others.

As taught herein, the speaker attenuation method, system, and apparatus is capable of improving evenness of tone of a speaker by reducing "beaminess" of the speaker without creating a "hole in the sound." As a result, audiences in large venues will be treated to a pleasing tone even when the sound technician places the microphone to the local PA system in the central beam region of the speaker. Moreover, audience members proximate to the speaker in the central beam region will also experience the pleasing tone, and not the "ice pick highs" or "sizzle" of an unattenuated speaker, or the "muddy" tone of a blocked speaker.

What is claimed is:

1. A speaker attenuation system, comprising:

an attenuating member comprised primarily of open cell foam and having a size and a shape operable to attenuate without substantially blocking sound energy emanating from the central beam region of a speaker when positioned in a central beam region of the speaker;

a positioning mechanism operable to position the attenuating member separate from the speaker so as not to interfere with the dynamics of the cone of the speaker and predominantly in the central beam region of the speaker in such a manner that it is between the speaker and an audience in a performance setting.

2. The system of claim 1, wherein open cell foam of said attenuating member is disc-shaped, four to eight inches in diameter, and one to three inches thick.

3. The system of claim 1, wherein said attenuating member is comprised of progressively removable layers of open cell foam.

4. The system of claim 1, wherein said positioning mechanism is operable to affix the attenuating member predominantly centered in front of a voice coil of the speaker so as to attenuate without blocking a majority of frequencies above one-thousand Hertz beamed from the voicecoil in a direction extending in front of the speaker.

5. The system of claim 1, wherein said positioning mechanism operably attaches the attenuating member to at least one of: a screen of a cabinet at least partially enclosing the speaker; a housing of the cabinet; a baffle board of the cabinet; or the speaker.

6. The system of claim 5, wherein said positioning mechanism includes a Velcro strap operable to affix said attenuating member to an exterior of the screen with respect to an interior of the cabinet.

7. The system of claim 5, wherein said positioning mechanism is operable to affix said attenuating member within an interior of the cabinet.

8. The system of claim 7, wherein said positioning mechanism operably affixes said attenuating member to an interior side of the screen, and the screen is operably removable in order to permit removal of layers of material of said attenuating member or replacement of said attenuating member with a second attenuating member of reduced thickness of open cell foam.

9. A speaker attenuation method, comprising:

selecting an attenuating member of open cell foam having a size, a shape, and a material composition of suitable properties to attenuate a speaker when positioned in a central beam region of the speaker;

identifying the central beam region of the speaker; and positioning the attenuating member separate from the speaker so as not to interfere with the dynamics of the cone of the speaker and predominantly in the central beam region of the speaker in such a manner that it is between the speaker and an audience in a performance setting, wherein the suitable properties include the ability, at one or more thicknesses, to reduce amplitude of a majority of frequencies in said central beam region between one-thousand and eight-thousand Hertz by at least six decibels without reducing amplitude of any frequencies in that range by more than eighteen decibels.

10. The method of claim 9, wherein selecting the attenuating member includes selection an attenuating member composed primarily of open cell foam.

11. The method of claim 10, wherein selecting the attenuating member includes selecting a disc-shaped attenuating member that is four to eight inches in diameter and one to three inches thick.

12. The method of claim 9, wherein selecting the attenuating member includes selecting an attenuating member comprised of progressively removable layers of suitable material.

13. The method of claim 9, further comprising removing a layer of material after the speaker ages and beaminess of the speaker decreases.

14. The method of claim 9, wherein positioning the attenuating member includes predominantly centering the attenuating member in front of a voice coil of the speaker so as to operably intercept a majority of frequencies above one-thousand Hertz beamed from the voicecoil in a direction extending in front of the speaker.

15. The method of claim 9, wherein positioning the attenuating member includes attaching the attenuating member to at least one of: a screen of a cabinet at least partially enclosing the speaker; a housing of the cabinet; a baffle board of the cabinet; or the speaker.

16. The method of claim 15, wherein attaching the attenuating member includes employing a Velcro strap to affix the attenuating member to an exterior of the screen with respect to an interior of the cabinet.

17. The method of claim 15, wherein attaching the attenuating member includes employing an attaching mechanism to affix the attenuating member within an interior of the cabinet.

18. The method of claim 17, wherein attaching the attenuating member includes affixing the attenuating member to an interior side of the screen, the method further comprising, selecting the screen to be removable in order to permit removal of layers of material of the attenuating member or replacement of the attenuating member with one selected to perform less attenuation.

19. The method of claim 9, wherein the suitable properties allow the material, at one or more thicknesses, to reduce amplitudes of all frequencies between two and five thousand Hertz by at least four decibels without succeeding in reducing amplitudes of any of those frequencies by more than twelve decibels.

20. The method of claim 9, wherein the suitable properties allow the material, at one or more thicknesses, to reduce amplitudes of a majority of frequencies between two thousand and five thousand Hertz by at least four decibels without succeeding in reducing amplitudes of any frequencies between one and five thousand Hertz by more than twelve decibels.

21. The method of claim 9, wherein selecting the attenuating member includes selecting the attenuating member to have a thickness of the suitable material that renders it operable reduce amplitude of the majority of frequencies between one-thousand and eight-thousand Hertz by less than six decibels.

22. A speaker attenuation apparatus, comprising:

an attenuating member of open cell foam comprised of a suitable material and having a size and a shape operable to attenuate without substantially blocking sound energy emanating from the central beam region of a speaker when positioned in a central beam region of the speaker;

a positioning mechanism operable to position the attenuating member separate from the speaker so as not to interfere with the dynamics of the cone of the speaker and predominantly in the central beam region of the speaker in such a manner that it is between the speaker and an audience in a performance setting, wherein the suitable material has a property that it is operable, at one or more thicknesses, to reduce amplitude of a majority of frequencies between one-thousand and eight-thousand Hertz by at least six decibels without reducing amplitude of any frequencies in that range by more than eighteen decibels.

23. The apparatus of claim 22, wherein the suitable material is open cell foam, disc-shaped, four to eight inches in diameter, and one to three inches thick.

24. The apparatus of claim 22, wherein said attenuating member is comprised of progressively removable layers of open cell foam.

25. The apparatus of claim 22, wherein said positioning mechanism is operable to affix the attenuating member predominantly centered in front of a voice coil of the speaker so as to operably intercept a majority of frequencies above one-thousand Hertz beamed from the voicecoil in a direction extending in front of the speaker.

26. The apparatus of claim 22, wherein said positioning mechanism operably attaches the attenuating member to at least one of: a screen of a cabinet at least partially enclosing the speaker; a housing of the cabinet; a baffle board of the cabinet; or the speaker.

27. The apparatus of claim 26, wherein said positioning mechanism includes a Velcro strap operable to affix said attenuating member to an exterior of the screen with respect to an interior of the cabinet.

28. The apparatus of claim 26, wherein said positioning mechanism is operable to affix said attenuating member within an interior of the cabinet.

29. The apparatus of claim 28, wherein said positioning mechanism operably affixes said attenuating member to an interior side of the screen, and the screen is operably removable in order to permit removal of layers of material of said attenuating member or replacement of said attenuating member with a second attenuating member of reduced thickness of open cell foam.

30. The apparatus of claim 22, wherein the suitable material has a property that it is operable, at one or more thicknesses, to operably reduce amplitudes of all frequencies between two and five thousand Hertz by at least four decibels without reducing amplitudes of any of those frequencies by more than twelve decibels.

31. The apparatus of claim 22, wherein the suitable material has a property that it is operable, at one or more thicknesses, to operably reduce amplitudes of a majority of frequencies between two thousand and five thousand Hertz by at least four decibels without reducing amplitudes of any frequencies between one and five thousand Hertz by more than twelve decibels.

32. The apparatus of claim 22, wherein said attenuating member has a thickness of the suitable material that renders it operable to reduce amplitude of the majority of frequencies between one-thousand and eight-thousand Hertz by less than six decibels.

* * * * *